US006918994B2

(12) United States Patent
Ochi et al.

(10) Patent No.: US 6,918,994 B2
(45) Date of Patent: Jul. 19, 2005

(54) SOFT PRINTING PAPER

(75) Inventors: Takashi Ochi, Tokyo (JP); Masaya Tosaka, Tokyo (JP); Takehide Kasahara, Tokyo (JP); Hideki Fujiwara, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 334 days.

(21) Appl. No.: 10/168,347

(22) PCT Filed: Dec. 15, 2000

(86) PCT No.: PCT/JP00/08895

§ 371 (c)(1),
(2), (4) Date: Sep. 13, 2002

(87) PCT Pub. No.: WO01/44572

PCT Pub. Date: Jun. 21, 2001

(65) Prior Publication Data

US 2003/0051840 A1 Mar. 20, 2003

(30) Foreign Application Priority Data

Dec. 17, 1999 (JP) ..... 11-359980
Nov. 24, 2000 (JP) ..... 2000-356868

(51) Int. Cl.[7] ..... D21H 17/00
(52) U.S. Cl. ..... 162/158; 162/168.3; 162/175; 162/179
(58) Field of Search ..... 162/158, 168.3, 162/175, 179

(56) References Cited

U.S. PATENT DOCUMENTS 5,385,642 A 1/1995 Van Phan et al.
5,494,731 A 2/1996 Fereshtchkhou et al.

FOREIGN PATENT DOCUMENTS

| | | |
|---|---|---|
| JP | 60-184875 | 9/1985 |
| JP | 06-128891 | 5/1994 |
| JP | 08-500858 | 1/1996 |
| JP | 08-246390 | 9/1996 |
| JP | 08-510299 | 10/1996 |
| JP | 10-204790 | 8/1998 |
| JP | 2971447 | 8/1999 |
| JP | 11-269799 | 10/1999 |
| WO | WO 94/05856 | 3/1994 |
| WO | WO 94/26974 | 11/1994 |
| WO | WO 98/03730 | 1/1998 |

*Primary Examiner*—Mark Halpern
(74) *Attorney, Agent, or Firm*—Knobbe, Martens, Olson & Bear LLP

(57) ABSTRACT

Printing paper superior in a texture, a feel and ease in turning the page is provided by adjusting the product of the paper density, the breaking length of a paper-making direction and the Young's modulus of the paper-making direction of the paper made by a paper machine within the limits of no less than $2\times10^{18}$ and no more than $10\times10^{18}$ $g\cdot N/m^4$ by using the following means independently or in appropriate combination: a means of lowering paper density by increasing the compounding ratios of low-density pulp and low-density filler, using bulking chemicals or reducing press pressure during paper-making process, a means of lowering the paper breaking length of a paper-making direction by improving the compounding ratios of filler, and a means of lowering the Young's modulus of the paper by using a softening agent.

23 Claims, No Drawings

SOFT PRINTING PAPER

This application is the U.S. National Phase under 35 U.S.C. §371 of International Application PCT/JP00/08895, filed Dec. 15, 2000, which claims priority to Japanese Patent Application No. 11/359980, filed Dec. 17, 1999, and No. 2000/356868, filed Nov. 24, 2000. The International Application was not published under PCT Article 21(2) in English.

TECHNICAL FIELD

The present invention relates to printing paper that is superior in suppleness and is bulky, and particularly relates to printing paper preferred for books.

BACKGROUND ART

Qualities such as a texture, a feel and ease in turning the page are important for bookpaper. Particularly recently, paper qualities such as lightness in spite of heftiness (i.e., tall paper thickness), i.e., bulkiness (low density), and ease in turning the pages when the paper is used for books are demanded. In the past, if paper thickness is increased, stiffness is increased, making it harder to turn the pages. For this reason it was difficult to manage to have both paper thickness and ease in turning the pages.

Generally, qualities such as a feel and ease in turning the pages are the factors that are affected by the suppleness of paper. It is, however, difficult to digitize the suppleness of paper all of a lump, because body, elasticity, strength and other qualities are associated with it. With the aim of improving the texture of paper used as bookpaper, in Japanese Patent Laid-open No.1996-246390, thin bookpaper for which specific spindle-shaped calcium carbonate is used as filler and in which mechanical pulp with a water-retention value of 100 to 150% is compounded, has been disclosed. In Japanese Patent Laid-open No.1998-204790, low-density bookpaper of 0.6 to 0.65 g/cm$^3$ in density, which contains 90 weight % or more hardwood kraft pulp (Freeness: CSF 500 ml or more) which the hardwood kraft pulp contains 50 to 100 weight % dipterocarp pulp, and which contains calcium carbonate as filler, has been disclosed. As for these bookpapers, however, because it was necessary to compound special pulp, they had a disadvantage cost-wise, and they fell short of suppleness and were not superior in texture and ease in turning the pages.

As environmental conservation is gaining momentum, producing lighter paper becomes a subject that cannot be avoided in terms of effectively utilizing paper pulp, which is produced from forest resources. Producing lighter paper has become a big current as well from the viewpoint of quality requirements for the bookpaper as mentioned in the above. Here, lighter paper implies reducing the weight of paper while maintaining the thickness of the paper, i.e. producing low-density (and bulky) paper.

As a method of lowering the density (increasing the bulkiness) of paper, paper pulp, which is a main raw ingredient of the paper, can be first examined. For the paper pulp, wood pulp is normally used. As pulp for reducing the density of paper, because of their stiff fibers, mechanical pulp such as ground pulp, which is obtained by grinding wood by a grinder without using a chemical, or thermo-mechanical pulp, which is obtained by fibrillating wood by a refiner, is more effective for lowering the density than chemical pulp, which is obtained by a chemical extraction of lignin, a reinforcing material contained in fibers. Particularly, ground pulp contributes largely to lowering the density. However, ground pulp, which is mechanical pulp, has a problem in compounding it in wood-free paper from the viewpoint of meeting the standards. Additionally, if it is compounded in the paper, there is a problem in paper quality (e.g., color reversion) with time. Consequently, compounding the ground pulp is impossible. By the same token, it is impossible to compound thermo-mechanical pulp as well.

In the case of wood-free paper, as for pulp, only chemical pulp can be compounded. By compounding chemical pulp, paper density is substantially affected by a pulpified wood type. In other words, the rougher and larger wood fibers themselves are, the easier lowering the density is possible. For wood-free paper, mainly hardwood pulp is compounded. Of the hardwood types, gumwood, maple and birch can be mentioned as wood types that can be used for lowering paper density. In a rise of the current environmental conservation trend, however, it is difficult to collect only these wood types by specifying them for pulping.

Mechanical paper or wood-containing paper, in which mechanical pulp is compounded, is a normally lower density paper than wood-free paper. Compounding stiff fibers causes picking (many of such incidents are caused by twined fibers derived from mechanical pulp) and lowers strength. Furthermore, because degree of brightness is degraded by increasing a compounding ratio of mechanical pulp whose degree of whiteness is lower than that of bleached chemical pulp, a compounding amount of mechanical pulp is restricted. With a recent growing tendency for environmental conservation and because of the need for protecting resources, increasing a compounding amount of recycled waste-paper pulp is called on. It is unlikely that recycled waste-paper pulp is pulpified by specifically grouping them according to paper quality types such as wood-free paper, newsprint paper, magazine paper, flyer paper, coated paper, etc. Instead, all different types of recycled waste paper are pulpified just as mixed. As a result, in terms of pulp qualities, density tends to become higher than that of virgin mechanical pulp. The reason for this is that fibers contained in recycled waster-paper pulp comprise a mixture of chemical pulp and mechanical pulp. Because talc, kaolin, clay and calcium carbonate, which are normally used as filler contained in paper or pigment for a coating layer of coating paper, have a higher density when compared with pulp, by compounding them, the density of paper tends to increase. Hence, increasing a compounding ratio of recycled waste-paper pulp tends to increase paper density.

As mentioned above, if taking the current status of wood resources and quality design of paper into consideration, it is very difficult to achieve sufficiently low density needed for the paper only from a pulp aspect.

Normally, for paper pulp, fibers are made supple by a refining process and are then fibrillated. Because bulkiness tends to decrease by the refining process, it is desirable not to perform refining process as much as possible for the purpose of increasing bulkiness. However, if the refining process is insufficient, strength decreases.

As a method for lowering density when making paper, pressure applied by a press should be brought down as much as possible during press process, and calendaring, which is performed to provide smoothness on the paper surface, should not be performed. Furthermore, it is desirable to use as little as possible of a coating amount for surface coating of water-soluble polymer such as starch. This coating is performed to provide the surface strength of paper when being printed.

In addition to applying some means at the time of pulping and making paper, fillers, which are compounded at a higher compounding ratio next to the pulp, have also been examined. For example, a method for achieving lower density by compounding hollow synthetic organic matter capsules as fillers has been disclosed in Japanese Patent Laid-open No.1993-339898. Synthetic organic expandable filler (e.g., a product name such as EXPANSEL manufactured by Nihon Filight), which achieves higher bulkiness by expanding by heat from a dryer portion of a paper machine, has been proposed. The method using these synthetic organic expandable fillers, however, has such problems that setting drying conditions is difficult, surface strength is weak and printing glossiness is lowered.

In Japanese Patent Publication No.1977-39924, a method using Shirasu-balloons has been proposed. In this method, there are such problems that they cannot be compounded in paper pulp well, and uneven printing results occur using the paper made in this method.

In Japanese Patent Laid-open No.1996-13380, a method for adding microscopic fibrillated cellulose has been disclosed. With this method, microscopic fibrillated cellulose has to be fabricated specially. At the time making paper, it is necessary to adjust freeness of pulp to CSF 400 ml or more, preferably to CSF 500 ml or more. It is difficult to adjust freeness for paper stock in which mechanical pulp is compounded at a high compounding ratio; therefore, it is difficult to use this method for making mechanical paper and wood-containing paper.

Using the above-mentioned methods, paper thickness was increased. However, because the paper thickness was increased, the stiffness of paper rose exponentially and suppleness of the paper was not improved. As a result, texture, feel and ease in turning the page were not sufficient.

DISCLOSURE OF INVENTION

The object of the present invention is to provide soft printing paper, which is satisfactory in its texture, feel and ease in turning the page and is low in paper density (i.e., high in bulkiness), with which paper breaks during printing are less, and which is superior in printability.

After devoting themselves to examine to solve the above-mentioned problems, the inventors of the present invention have found that printing paper possessing suppleness, which is satisfactory in its texture, feel and ease in turning the page and at the same time has high bulkiness, can be obtained by specifying the product of the paper density, the breaking length of a paper-making direction and the Young's modulus of the paper-making direction to be no less than $2\times10^{18}$ and no more than $10\times10^{18}$ g·N/m$^4$.

To provide both the suppleness of paper including texture, a feel and ease in turning the page and lightness and bulkiness (tall paper thickness), which are required for bookpaper, the inventors of the present invention examined to quantify qualities which paper suppleness affected. They first examined Clark stiffness and found that Clark stiffness did not always correlates with actual texture, etc. and that even with a low Clark stiffness value, satisfactory texture was not always obtained. Additionally, it was found that the lower the values of paper strength and the Young's modulus were, paper texture tended to be excellent. By increasing paper thickness using conventionally known methods for creating bulkiness, suppleness decreased. With this view, by further examining paper suppleness, they found that supple paper could be manufactured by simultaneously lowering paper strength and the Young's modulus. In other words, it was found that, to obtain paper possessing lightness, bulkiness and suppleness, which is the object of the present invention, lowering the values of the Young's modulus and the paper density simultaneously in a balanced manner was effective. After dedicating to further examination, it was found that there was satisfactory correlation with the product of the paper density, the breaking length of a paper-making direction and the Young's modulus of the paper-making direction. More specifically, it was found that the lower the product of the three was, the suppler and the bulkier (the lower in density) the paper was, and that if the product of the three was within the limits of $2\times10^{18}$ to $10\times10^{18}$ g·N/m$^4$, the texture and feel of the paper were satisfactory, the paper was light and bulky, and the paper had less problems in breaks on a paper machine and a printing press. Particularly, if the product of the three is within the limits of $2\times10^{18}$ to $5\times10^{18}$ g·N/m$^4$, the paper concerned is preferable for bookpaper.

To specify the product of the breaking length of a paper-making direction and the Young's modulus of the paper-making direction at the above-mentioned value, it is necessary that printing paper according to the present invention be made using a paper machine. In other words, in the case of paper made using a hand sheet machine, whose fiber direction is nondirectional, it is impossible to adjust the values to the values of the breaking length of a paper-making direction and the Young's modulus of the paper-making direction according to the present invention. Even if a hand sheet machine with which an orientation can be provided is used, density cannot be adjusted to the density according to the present invention because it is impossible to make the conditions for press, drying and calendaring processes uniform with the conditions for the paper machine. As mentioned above, by lowering the strength, there are concerns about paper breaks on the paper machine and a printing press. However, it is inferred that if the Young's modulus is lowered simultaneously, paper becomes easy to expand when load is applied and if it is within the elasticity limits. Consequently, it makes harder to cause partial concentration of stress, resulting in making more difficult to cause paper breaks even if paper strength is decreased.

For this reason, as a paper machine, a publicly known machine such as a Fourdrinier machine or a twin-wire type machine such as an on-top former type, a hybrid former type or a gap former type machine is used.

Paper having regular density and the product of the three being less than $2\times10^{18}$ g·N/m$^4$ means that its Young's modulus is low. Because the paper is exceedingly supple, it does not have body. Besides, because its strength is exceedingly low, it becomes easy to break during paper-making and printing. Paper with the product of the three being less than $2\times10^{18}$ g·N/m$^4$ means that it has excessively low density. For such paper, pressure applied at press and calendaring during the paper-making process needs to be extremely low. For this reason, its smoothness is significantly low and it is difficult to use it for printing.

In the case of paper having regular density and the product of the three being more than $10\times10^{18}$ g·N/m$^4$, its breaking length is excessively long or its Young's modulus is high. The paper becomes stiff and its texture lowers. In the case of paper with regular breaking length and Young's modulus values and the product of the three being more than $10\times10^{18}$ g·N/m$^4$, it means that its density is extremely high, hence it does not serve as the paper according to the present invention, which should be bulky.

Furthermore, the inventors of the present invention found that the breaking length of a paper-making direction was important in paper suppleness. Because the breaking length depends on the strength of inter-fiber bonding, it is considered that it can be used as an index of paper suppleness. If the above-mentioned product of the three values is no less than $2\times10^{18}$, no more than $10\times10^{18}$ g·N/m$^4$ and the breaking length is no more than 4 km, the paper has satisfactory suppleness as bookpaper.

BEST MODES FOR CARRYING THE INVENTION

In the present invention, confining the product of the paper density, the breaking length of a paper-making direction and the Young's modulus of the paper-making direction within the limits of $2\times10^{18}$ to $10\times10^{18}$ g·N/m$^4$ can be achieved by using respective means of lowering the paper density, the breaking length of a paper-making direction and the Young's modulus of the paper-making direction independently or in combination. As methods for lowering paper density, increasing compounding ratios of low-density pulp and low-density filler, use of bulking chemicals and reducing press pressure during paper-making process can be mentioned. As methods for lowering the breaking length, increasing a compounding ratio of filler and others can be mentioned. As methods for lowering the Young's modulus of paper, use of a softening and others can be mentioned.

A softening agent used in the present invention should have an action to block inter-fiber bonding of pulp or to supple fibers themselves. For example, some surfactants possessing hydrophobic groups and hydrophilic groups have this action. For example, oil-nonionic surfactants, sugar alcohol nonionic surfactants, sugar nonionic surfactants, polyalcohol type nonionic surfactants, higher alcohol, ester compound of polyalcohol and fatty acid, polyoxyalkylene additive of higher alcohol or higher fatty acid, polyoxyalkylene additive of higher fatty acid ester, polyoxyalkylene additive which is an ester compound of polyalcohol and fatty acid, fatty acid polyamideamine, etc. can be mentioned as examples. As long as it can increase paper suppleness, compounds or combinations are not limited to those mentioned above. Using a surfactant which can lower the breaking length and the density in addition to lowering the Young's modulus is one of the preferred modes for carrying out the present invention.

To confine the product of the paper density, the breaking length of a paper-making direction and the Young's modulus of the paper-making direction within the limits of $2\times10^{18}$ to $10\times10^{18}$ g·N/m$^4$, an amount of a softening agent to be added is determined in consideration of a compounding ratio of pulp, a filler content, internally-added chemicals, etc. Normally, paper should be made by adding a softening agent into paper stock within the limits of 0.1 to 5 weight % per pulp absolute dry weight.

As raw ingredient pulp for the printing paper possessing suppleness according to the present invention, chemical pulp such as softwood bleached Kraft pulp (NBKP) or unbleached Kraft pulp (NUKP), hardwood bleached Kraft pulp (LBKP) or unbleached hardwood bleached Kraft pulp (LUKP), etc., mechanical pulp such as ground pulp (GP), thermo-mechanical pulp (TMP), chemical-thermo-mechanical pulp (CTMP), etc., deinked pulp (DIP) are used independently or by mixing them at an optional ratio.

The pH of the paper possessing suppleness according to the present invention can be any of acid, neutral or alkaline. Because the breaking length and the Young's modulus of paper tend to decrease if the paper contains filler, containing the filler is preferable. As filler, publicly-known fillers such as hydrated silicic acid, white carbon, talc, kaolin, clay, calcium carbonate, titanium white, synthetic resin fillers, etc. can be used.

Furthermore, the paper possessing suppleness according to the present invention can also contain an alum, a sizing agent, a paper strength agent, a retention aid, a coloring agent, dyestuff, a deforming agent, etc.

Additionally, within the limits not affecting the density, the breaking length and the Young's modulus, a surface-preparation agent mainly comprising water-soluble polymer, etc. can be coated on the paper possessing suppleness according to the present invention for the purpose of improving surface strength and sizing property (a property to stop blotting).

As water-soluble polymer, oxidized starch, hydroxyethyl-etherificated starch, oxygen-denaturated starch, polyacrylamide, polyvinyl alcohol, etc., which are normally used as a surface-preparation agent, can be used independently or as a mixture. Additionally, in the surface-preparation agent, in addition to the water-soluble polymer, a paper durability strengthener, which improves water resistance and surface strength and an external sizing agent providing the sizing property, can be added. The surface-preparation agent can be coated using a coating machine such as a two-roll size press coater, a gate roll coater, a blade metering coater, or a rod metering coater etc.

As mentioned above, by specifying the product of the paper density, the breaking length of a paper-making direction and the Young's modulus of the paper-making direction to be no less than $2\times10^{18}$ and no more than $10\times10^{18}$ g·N/m$^4$, printing paper that is bulky but light and which has excellent suppleness can be obtained. The printing paper possessing bulkiness and suppleness according to the present invention can also be used for offset paper, letterpress printing paper, rotogravure paper, electrophotographic paper or base paper for coated paper, inkjet printing paper, thermosensitive paper, pressure sensitive chart paper, etc. as well as for bookpaper.

The present invention is described below further using embodiments. The present invention, however, is not limited to those embodiments.

EMBODIMENTS

Regarding each paper made as described in the embodiments and comparative examples below, the density, the breaking length of a paper-making direction and the Young's modulus of the paper-making direction of the paper were measured and the product of the three was calculated. Further, texture of the paper was evaluated.

Methods used for measuring the above-mentioned items were as follows:

Density: In accordance with JIS P 8118-1998.

Breaking length: In accordance with JIS P 8113-1998, the breaking length of a paper-making direction was measured and a value obtained was used as the breaking length of the paper.

Young's modulus: In accordance with JIS P 8113-1998, the modulus of elasticity in tension was measured and a value obtained was used as the Young's modulus of the paper.

Evaluation of suppleness: Texture and a feel were evaluated by 10 monitors using four scales of: ○○ (Very excellent), ○ (excellent), Δ (slightly having problems), and X (having problems).

Embodiment 1

Paper was made by an on-top former type paper machine from paper stock prepared using LBKP (freeness: 350 ml) as pulp and containing 10 weight % calcium carbonate per paper weight as filler. Starch was coated on the paper by an on-machine size press coater with 3.6 g/m$^2$ of starch as the coating amount. Thus, wood-free bookpaper was made. The evaluation results are shown in Table 1.

Embodiment 2

Paper was made by an on-top former type paper machine from paper stock prepared using LBKP (freeness: 410 ml) as pulp and containing 0.4 weight % KB-115 manufactured by Kao Chemicals as a softening agent and 28 weight % calcium carbonate per paper weight as filler. Starch was coated on the paper by an on-machine size press coater with 5.1 g/m$^2$ of starch as the coating amount. Thus, wood-free bookpaper was made. The evaluation results are shown in Table 1.

Comparative Example 1

Paper was made by an on-top former type paper machine from paper stock prepared using LBKP (freeness: 410 ml) as pulp and containing 25 weight % calcium carbonate per paper weight as filler. Starch was coated on the paper by an on-machine size press coater with 3.7 g/m$^2$ of starch as the coating amount. Thus, wood-free bookpaper was made. The evaluation results are shown in Table 1.

Comparative Example 2

Paper was made by an on-top former type paper machine from paper stock prepared using LBKP (freeness: 345 ml) as pulp and containing 25 weight % calcium carbonate per paper weight as filler. Starch was coated on the paper by an on-machine size press coater with 3.7 g/m$^2$ of starch as the coating amount. Thus, wood-free bookpaper was made. The evaluation results are shown in Table 1.

containing 20 weight % calcium carbonate per paper weight as filler. Starch and polyvinyl alcohol (Weight ratio: 85:15) were coated on the paper by an on-machine size press coater with 4.5 g/m$^2$ of starch as the coating amount. Thus, wood-free bookpaper was made. The evaluation results are shown in Table 1.

Comparative Example 5

Paper was made by a Fourdrinier machine from paper stock prepared using LBKP (freeness: 350 ml) as pulp and containing 29 weight % calcium carbonate per paper weight as filler. Starch was coated on the paper by an on-machine size press coater with 3.7 g/m$^2$ of starch as the coating amount. Thus, wood-free bookpaper was made. The evaluation results are shown in Table 1.

Comparative Example 6

Paper was made by an on-top former type paper machine from paper stock prepared using LBKP (freeness: 360 ml) as pulp and containing 28 weight % calcium carbonate per paper weight as filler. Starch was coated on the paper by an on-machine size press coater with 3.8 g/m$^2$ of starch as the coating amount. Thus, wood-free bookpaper was made. The evaluation results are shown in Table 1.

Comparative Example 7

Paper was made by an on-top former type paper machine from paper stock prepared using LBKP (freeness: 360 ml) as pulp and containing 28 weight % calcium carbonate per paper weight as filler. Starch was coated on the paper by an on-machine size press coater with 3.8 g/m$^2$ of starch as the coating amount. Thus, wood-free bookpaper was made. The evaluation results are shown in Table 1.

TABLE 1

| | Basis weight (g/m$^2$) | Density (g/cm$^3$) | Breaking length (km) | Young's modulus (kN/m$^2$ × 10$^6$) | Density × Breaking length × Young's modulus (g · N/m$^4$ × 10$^{18}$) | Texture | Softening agent Added |
|---|---|---|---|---|---|---|---|
| Embodiment 1 | 79.7 | 0.57 | 4.50 | 3.33 | 8.54 | ○ | No |
| Embodiment 2 | 80.7 | 0.61 | 2.62 | 3.14 | 5.02 | ○○ | Yes |
| Comp. Ex. 1 | 70.8 | 0.66 | 4.95 | 4.54 | 14.8 | Δ | No |
| Comp. Ex. 2 | 72.9 | 0.80 | 5.29 | 5.43 | 23.0 | X | No |
| Comp. Ex. 3 | 73.3 | 0.84 | 7.50 | 6.38 | 40.2 | X | No |
| Comp. Ex. 4 | 78.3 | 0.81 | 7.30 | 6.00 | 35.5 | X | No |
| Comp. Ex. 5 | 81.8 | 0.80 | 5.60 | 5.81 | 26.0 | X | No |
| Comp. Ex. 6 | 85.5 | 0.71 | 4.69 | 4.45 | 14.8 | Δ | No |
| Comp. Ex. 7 | 88.3 | 0.67 | 4.17 | 4.36 | 12.2 | Δ | No |

Comparative Example 3

Paper was made by a paper machine from paper stock prepared using LBKP (freeness: 317 ml) as pulp and containing 26 weight % calcium carbonate per paper weight as filler. Starch and polyvinyl alcohol (Weight ratio: 85:15) were coated on the paper by an on-machine size press coater with 4.4 g/m$^2$ of starch as the coating amount. Thus, wood-free bookpaper was made. The evaluation results are shown in Table 1.

Comparative Example 4

Paper was made by an on-top former type paper machine from paper stock prepared using mixed pulp (freeness: 350 ml) in which 95 parts LBKP by weight and 5 parts softwood kraft pulp (NBKP) by weight were mixed as pulp and Embodiment 3

Paper was made by a twin-wire paper machine from paper stock prepared using mixed pulp in which 10 parts NBKP by weight, 35 parts LBKP by weight, 40 parts GP by weight and 15 parts TMP by weight were mixed as pulp and containing 1 weight % KB-115 manufactured by Kao Chemicals per pulp as a softening agent and 10 weight % kaolin per paper weight as filler. Starch was coated on the paper by an on-machine size press coater with 3.0 g/m$^2$ of starch as the coating amount. Thus, wood-containing bookpaper was made. The evaluation results are shown in Table 2.

Embodiment 4

Paper was made by a twin-wire type paper machine from paper stock prepared using mixed pulp in which 3 parts NBKP by weight, 70 parts GP by weight and 27 parts DIP by weight were mixed as pulp and containing 1 weight % KB-08W manufactured by Kao Chemicals per pulp as a softening agent. Thus, wood-containing bookpaper was made. The evaluation results are shown in Table 2.

Embodiment 5

Paper was made by a twin-wire paper machine from paper stock prepared using mixed pulp in which 10 parts NBKP by weight, 35 parts LBKP by weight, 40 parts GP by weight and 15 parts TMP by weight were mixed as pulp and containing 1 weight % KB-115 manufactured by Kao Chemicals per pulp as a softening agent and 10 weight % kaolin per paper weight as filler. Starch was coated on the paper by an on-machine size press coater with 3.0 g/m$^2$ of starch as the coating amount. Thus, wood-containing bookpaper was made. The evaluation results are shown in Table 2.

Embodiment 6

Paper was made by a twin-wire paper machine from paper stock prepared using mixed pulp in which 10 parts NBKP by weight, 35 parts LBKP by weight, 40 parts GP by weight and 15 parts TMP by weight were mixed as pulp and containing 1 weight % KB-115 manufactured by Kao Chemicals per pulp as a softening agent and 10 weight % kaolin per paper weight as filler. Starch was coated on the paper by an on-machine size press coater with 3.0 g/m$^2$ of starch as the coating amount. Thus, wood-containing bookpaper was made. The evaluation results are shown in Table 2.

Embodiment 7

Paper was made by a twin-wire paper machine from paper stock prepared using mixed pulp in which 9 parts NBKP by weight, 7 parts LBKP by weight, 42 parts GP by weight and 42 parts TMP by weight were mixed as pulp and containing 0.6 weight % KB-115 manufactured by Kao Chemicals per pulp as a softening agent and 5 weight % calcium carbonate per paper weight as filler. Starch was coated on the paper by an on-machine size press coater with 1.8 g/m$^2$ of starch as the coating amount. Thus, wood-containing bookpaper was made. The evaluation results are shown in Table 2.

Embodiment 8

Paper was made by a twin-wire paper machine from paper stock prepared using mixed pulp in which 9 parts NBKP by weight, 7 parts LBKP by weight, 42 parts GP by weight and 42 parts TMP by weight were mixed as pulp and containing 0.8 weight % KB-115 manufactured by Kao Chemicals per pulp as a softening agent and 5 weight % calcium carbonate per paper weight as filler. Starch was coated on the paper by an on-machine size press coater with 1.8 g/m$^2$ of starch as the coating amount. Thus, wood-containing bookpaper was made. The evaluation results are shown in Table 2.

Embodiment 9

Paper was made by a Fourdrinier machine from paper stock prepared using mixed pulp in which 4 parts NBKP by weight, 40 parts LBKP by weight, 31 parts GP by weight and 33 parts TMP by weight were mixed as pulp and containing 4 weight % amorphous silicate per paper weight as filler. Starch was coated on the paper by an on-machine size press coater with 1.9 g/m$^2$ of starch as the coating amount. Thus, wood-containing bookpaper was made. The evaluation results are shown in Table 2.

Embodiment 10

Paper was made by a Fourdrinier machine from paper stock prepared using mixed pulp in which 9 parts NBKP by weight, 7 parts LBKP by weight, 42 parts GP by weight and 42 parts TMP by weight were mixed as pulp and containing 5 weight % calcium carbonate per paper weight as filler. Starch was coated on the paper by an on-machine size press coater with 1.8 g/m$^2$ of starch as the coating amount. Thus, wood-containing bookpaper was made. The evaluation results are shown in Table 2.

Embodiment 11

Paper was made by a Fourdrinier machine from paper stock prepared using mixed pulp in which 75 parts LBKP by weight and 25 parts TMP by weight were mixed as pulp and containing 0.8 weight % KB-115 manufactured by Kao Chemicals per pulp as a softening agent and 20 weight % calcium carbonate per paper weight as filler. Starch was coated on the paper by an on-machine size press coater with 6.0 g/m$^2$ of starch as the coating amount. Thus, wood-containing bookpaper was made. The evaluation results are shown in Table 2.

Comparative Example 8

Paper was made by a twin-wire paper machine from paper stock prepared using mixed pulp in which 19 parts NBKP by weight, 28 parts LBKP by weight, 20 parts GP by weight, 20 parts TMP by weight and 13 parts DIP by weight were mixed as pulp and containing 8 weight % calcium carbonate per paper weight as filler. Starch was coated on the paper by an on-machine size press coater with 1.8 g/m$^2$ of starch as the coating amount. Thus, wood-containing bookpaper was made. The evaluation results are shown in Table 2.

Comparative Example 9

Regarding wood-containing paper on the market (Product name: New Cream Bulky manufactured by Oji Paper), the evaluation results are shown in Table 2.

Comparative Example 10

Paper was made by a twin-wire paper machine from paper stock prepared using mixed pulp in which 52 parts NBKP by weight, 8 parts LBKP by weight and 41 parts GP by weight were mixed as pulp and containing 6 weight % amorphous silicate per paper weight as filler. Starch was coated on the paper by an on-machine size press coater with 1.8 g/m$^2$ of starch as the coating amount. Thus, wood-containing bookpaper was made. The evaluation results are shown in Table 2.

Comparative Example 11

Paper was made by a Fourdrinier machine from paper stock prepared using mixed pulp in which 75 parts LBKP by weight and 25 parts TMP by weight were mixed as pulp and containing 20 weight % calcium carbonate per paper weight as filler. Starch was coated on the paper by an on-machine size press coater with 6.0 g/m$^2$ of starch as the coating amount. Thus, wood-containing bookpaper was made. The evaluation results are shown in Table 2.

Comparative Example 12

Paper was made by a twin-wire paper machine from paper stock prepared using mixed pulp in which 6 parts NBKP by weight, 10 parts GP by weight, 16 parts TMP by weight and 68 parts DIP by weight were mixed as pulp. Starch was coated on the paper by an on-machine size press coater with 0.7 g/m$^2$ of starch as the coating amount. Thus, wood-containing bookpaper was made. The evaluation results are shown in Table 2.

TABLE 2

| | Basis weight ($g/m^2$) | Density ($g/cm^3$) | Breaking length (km) | Young's modulus ($kN/m^2 \times 10^6$) | Density × Breaking length × Young's modulus ($g \cdot N/m^4 \times 10^{18}$) | Texture | Softening agent Added |
|---|---|---|---|---|---|---|---|
| Embodiment 3 | 55.2 | 0.49 | 3.12 | 2.04 | 3.12 | ○○ | Yes |
| Embodiment 4 | 55.8 | 0.34 | 3.53 | 1.90 | 2.28 | ○○ | Yes |
| Embodiment 5 | 56.0 | 0.53 | 2.97 | 2.34 | 3.68 | ○○ | Yes |
| Embodiment 6 | 65.8 | 0.55 | 3.24 | 2.34 | 4.17 | ○○ | Yes |
| Embodiment 7 | 85.6 | 0.49 | 4.14 | 2.92 | 5.92 | ○ | Yes |
| Embodiment 8 | 67.0 | 0.48 | 3.98 | 2.70 | 5.16 | ○○ | Yes |
| Embodiment 9 | 75.8 | 0.54 | 4.60 | 3.40 | 8.45 | ○ | No |
| Embodiment 10 | 84.8 | 0.52 | 4.60 | 3.18 | 7.61 | ○ | No |
| Embodiment 11 | 88.4 | 0.60 | 4.16 | 3.55 | 8.86 | ○ | Yes |
| Comp. Ex. 8 | 58.5 | 0.77 | 4.20 | 4.81 | 15.6 | Δ | No |
| Comp. Ex. 9 | 61.0 | 0.57 | 5.48 | 3.89 | 12.2 | Δ | No |
| Comp. Ex. 10 | 75.8 | 0.61 | 4.50 | 3.74 | 10.3 | Δ | No |
| Comp. Ex. 11 | 102.8 | 0.60 | 6.28 | 3.90 | 14.7 | Δ | No |
| Comp. Ex. 12 | 45.5 | 0.62 | 6.86 | 5.22 | 22.0 | X | No |

As shown in Table 1 and Table 2, if the product of the paper density, the breaking length of a paper-making direction and the Young's modulus of the paper-making direction is within the limits of no less than $2\times10^{18}$ and no more than $10\times10^{18}$ $g\cdot N/m^4$, regardless of differences in pulp composition and filler used, paper is superior in suppleness and serves excellently as bookpaper.

Industrial Applicability

The suppleness of paper, which indicates qualities such as paper texture, feel and ease in turning the page, complexly relates to body, elasticity, strength and other qualities of the paper, and conventionally it was difficult to digitize these qualities. Aiming at improvement of a texture as bookpaper, however, the present invention was able to digitize the factors affecting the suppleness of the paper.

Consequently, the present invention was able to provide bookpaper, which is light in weight and low in density while it possesses a texture, a feel, ease in turning the page and bulkiness (tall paper thickness) and at the same time, turning the pages is easy when the paper is used for books.

What is claimed is:

1. A soft printing paper having a density of less than 0.6 $g/cm^3$, wherein the product of the density, a breaking length of a paper-making direction, and Young's modulus of the paper-making direction is no less than $2\times10^{18}$ $g\cdot N/m^4$ and no more than $10\times10^{18}$ $g\cdot N/m^4$.

2. The soft printing paper as claimed in claim 1, wherein the printing paper is made by a paper machine and the product of the density, the breaking length, and Yong's modulus is adjusted by using the following means independently or in combination: a means of adjusting paper density by improving the compounding ratios of low-density pulp and low-density filler, using bulking chemicals, or reducing press pressure during paper-making process, a means of adjusting the paper breaking length of a paper-making direction by improving the compounding ratios of low-density pulp and low-density filler, and a means of lowering the Young's modulus of the paper by using a softening agent.

3. The soft printing paper as claimed in claim 2, which comprises a component having an action to block inter-fiber bonding of pulp or a component suppling fibers themselves, as the softening agent.

4. The soft printing paper as claimed in claim 3, wherein said softening agent is at least one selected from the group consisting of oil-nonionic surfactants, sugar alcohol nonionic surfactants, sugar nonionic surfactants, polyalcohol type nonionic surfactants, higher alcohol, ester compound of polyalcohol and fatty acid, polyoxyalkylene additive of higher alcohol or higher fatty acid, polyoxyalkylene additive of higher fatty acid ester, polyoxyalkylene additive which is an ester compound of polyalcohol and fatty acid, and fatty acid polyamideamine.

5. The soft printing paper as claimed in claim 3, which comprises the softening agent within the limits of 0.1 to 5 weight % per pulp dry weight to paper stock.

6. The soft printing paper as claimed in claim 3, wherein a surface-preparation agent comprising a water-soluble polymer is coated on the printing paper.

7. The soft printing paper as claimed in claim 3, wherein the breaking length of the paper-making direction is no more than 4 Km.

8. The soft printing paper as claimed in claim 2, wherein said softening agent is at least one selected from the group consisting of oil-nonionic surfactants, sugar alcohol nonionic surfactants, sugar nonionic surfactants, polyalcohol type nonionic surfactants, higher alcohol, ester compound of polyalcohol and fatty acid, polyoxyalkylene additive of higher alcohol or higher fatty acid, polyoxyalkylene additive of higher fatty acid ester, polyoxyalkylene additive which is an ester compound of polyalcohol and fatty acid, and fatty acid polyamideamine.

9. The soft printing paper as claimed in claim 8, which comprises the softening agent within the limits of 0.1 to 5 weight % per pulp dry weight to paper stock.

10. The soft printing paper as claimed in claim 8, wherein a surface-preparation agent comprising a water-soluble polymer is coated on the printing paper.

11. The soft printing paper as claimed in claim 1, wherein the breaking length of the paper-making direction is no more than 4 Km.

12. The soft printing paper as claimed in claim 2, which comprises the softening agent within the limits of 0.1 to 5 weight % per pulp dry weight to paper stock.

13. The soft printing paper as claimed in claim 12, wherein a surface-preparation agent comprising a water-soluble polymer is coated on the printing paper.

14. The soft printing paper as claimed in claim 2, wherein the breaking length of the paper-making direction is no more than 4 Km.

15. The soft printing paper as claimed in claim 2, wherein a surface-preparation agent comprising a water-soluble polymer is coated on the printing paper.

16. The soft printing paper as claimed in claim 2, wherein the breaking length of the paper-making direction is no more than 4 Km.

17. The soft printing paper as claimed in any one of claims 1, wherein a surface-preparation agent comprising a water-soluble polymer is coated on the printing paper.

18. The soft printing paper as claimed in claim 17, wherein the water-soluble polymer is at least one selected from the group consisting of a starch, oxidized starch, hydroxyethyl-etherificated starch, oxygen-denaturated starch, polyacrylamide, and polyvinyl alcohol.

19. The soft printing paper as claimed in claim 3, wherein the breaking length of the paper-making direction is no more than 4 Km.

20. The soft printing paper as claimed in claim 1, wherein the breaking length of the paper-making direction is no more than 4 Km.

21. The soft printing paper as claimed in claim 1, wherein the density is 0.34 $g/cm^3$ to 0.57 $g/cm^3$.

22. The soft printing paper as claimed in claim 1, wherein Young's modulus of the paper-making direction is 1.90 to 3.55 $N/m^2 \times 10^{18}$.

23. The soft printing paper as claimed in claim 1, wherein a breaking length of a paper-making direction is 2.62 to 4.60 Km.

* * * * *